US007305718B2

(12) United States Patent
Avallone

(10) Patent No.: US 7,305,718 B2
(45) Date of Patent: Dec. 11, 2007

(54) FIREARM SAFETY GLOVES AND WRISTBANDS

(76) Inventor: Ralph Avallone, 300 Pelham Rd., Suite 8Q, New Rochelle, NY (US) 10805

( * ) Notice: Subject to any disclaimer, the term of this patent is extended or adjusted under 35 U.S.C. 154(b) by 97 days.

(21) Appl. No.: 11/073,259

(22) Filed: Mar. 4, 2005

(65) Prior Publication Data

US 2005/0193466 A1 Sep. 8, 2005

Related U.S. Application Data

(60) Provisional application No. 60/550,370, filed on Mar. 5, 2004.

(51) Int. Cl.
*A41D 19/00* (2006.01)

(52) U.S. Cl. ..... 2/159; 2/162; 2/11; 2/160; 2/161.6; 2/170; 2/311; 2/312; 2/17; 2/161.5; 224/244; 224/264; 224/219; 224/164; 473/464

(58) Field of Classification Search ..... 2/159, 2/161.4, 162, 11, 160, 161.6, 170, 311, 312, 2/17, 161.5; 224/244, 267, 219, 164; 473/464
See application file for complete search history.

(56) References Cited

U.S. PATENT DOCUMENTS

| | | | | |
|---|---|---|---|---|
| 1,361,565 | A * | 12/1920 | Christy | 2/313 |
| 2,288,150 | A * | 6/1942 | Wyman | 473/205 |
| 4,863,084 | A * | 9/1989 | Nabozny | 224/673 |
| 5,517,694 | A * | 5/1996 | Fabry | 2/161.1 |
| 5,557,806 | A * | 9/1996 | Caswell et al. | 2/161.1 |
| 5,845,374 | A * | 12/1998 | Briggs | 24/442 |
| 6,687,916 | B2 * | 2/2004 | Thompson | 2/170 |
| 2004/0018899 | A1 * | 1/2004 | Thiruppathi | 473/464 |

* cited by examiner

*Primary Examiner*—Gary L. Welch
*Assistant Examiner*—Alissa J Tompkins
(74) *Attorney, Agent, or Firm*—Fish & Richardson P.C.

(57) ABSTRACT

A firearm safety retaining glove or wristband includes an adjustable wristband or wristband portion releasably securable about a users wrist, a safety retaining strap attached at one end to the wristband or wristband portion, and extendable forwardly to and between a user's fingers and the trigger guard of a firearm held by the user, thence to the opposite side of the wristband or wristband portion, where it is releasably securable to the wristband, preferably by passing through a D-ring attached to the wristband, folded back on itself, and releasably secured to itself with a hook-and-loop closure.

6 Claims, 4 Drawing Sheets

FIREARM SAFETY GLOVES AND WRISTBANDS

TECHNICAL FIELD

This invention relates to firearms and more particularly to prevent the user from losing control of his or her firearm. This application claims the benefit of prior U.S. provisional application 60/550,370, filed Mar. 5, 2004.

BACKGROUND

Firearms, for example, handguns, rifles and shotguns, are used by law enforcement personnel and citizens licensed to carry such weapons, as well as by hunters and persons who engage in recreational target shooting.

Loss of control of one's firearm is a danger for users. For all users, particularly hunters, dropping one's firearm presents a danger to oneself and one's companions due to unintended discharge. For carriers of handguns, particularly law enforcement personnel, loss of one's weapon to another person either by a quick grab or through a struggle presents a danger to oneself, associates and the public by the weapon's ending up in the control of said other person.

SUMMARY

This invention includes both a glove and a wristband for a firearm user. The glove includes an adjustable wristband portion that can be tightened and releasably secured to the wrist of a person wearing the glove. The wristband embodiment is such an adjustable wristband.

Securely attached to the back side of the wristband in either case, by which I mean the side away from the palm of the wearer's hand, is a safety retaining strap. Securely attached to the palm side of the wristband in either case is a releasable locking mechanism, such as a buckle, or a portion of a releasable locking mechanism, such as a D-ring or other strong reversing loop that cooperates with a hook-and-loop closure forming part of the retaining strap. Preferred embodiments utilize a D-ring or other loop and hook-and-loop closure both to releasably secure the tightened wristband and to releasably secure the retaining strap to itself.

For use, a firearm user tightens and releasably secures the glove or wristband around his or her wrist, thereby preventing the same from falling off or from being pulled off accidentally or purposely by another person. The user grips the firearm as if to fire it, (preferably without engaging the trigger, however), and with his or her other hand pulls the retaining strap forward, passes it between two fingers, the index and middle fingers being recommended, then through the rear of the firearm's trigger guard, and then back to the wristband on the palm side. Finally the safety retaining strap is tightened and secured to the palm side of the wristband. While this can be done with a buckle or another releasable strap-securing device affixed to the palm side of the wristband, my preference is to pass the retaining strap through a D-ring attached to the wristband and tighteningly fold the strap back on itself and secure it in place with a hook-and-loop closure, commonly available under the trademark VELCRO (Velcro USA, Inc., Manchester, New Hampshire). While one portion of the hook-and-loop closure could be on the retaining strap and the other portion could be on the palm face of the glove, I prefer that both portions be on the strap, which is then secured to itself.

Once secured, the firearm cannot be pulled away from the user. The retaining strap is locked to his or her wrist. The releasable securing device is itself protected from being pulled open, as it is protected by the user's hand. In a struggle, another person cannot wrest the firearm away from the user, which is particularly important for law enforcement persons who utilize handguns. Another feature of the safety retaining system of this invention is that the user's hand is not locked to the firearm. A user can swing his or her hand free to perform a task without losing control of the firearm, which can quickly be swung back into firing position when needed. This feature, while obviously beneficial to law enforcement personnel, is also quite beneficial for a recreational user, who can free his or her hand in case needed, for example in case of a fall, without losing control of the weapon, thereby lessening the danger from accidental discharge.

Preferred embodiments of gloves and wristbands according to this invention are storable, either on or off the user, with the lengthy retaining strap wrapped around the wristband and releasably secured in that configuration, preferably with hook-and-loop fasteners. The glove or wristband can easily be carried in a pocket, put on when possible need is foreseen but stored on the user without a dangling retaining strap, or worn until needed, and quickly and easily engaged when the user takes up a firearm.

The details of one or more embodiments of the invention are set forth in the accompanying drawings and the description below. Other features, objects, and advantages of the invention will be apparent from the description and drawings, and from the claims.

BRIEF DESCRIPTION OF DRAWINGS

Like reference symbols in the various drawings indicate like elements.

DETAILED DESCRIPTION

Figure 1:
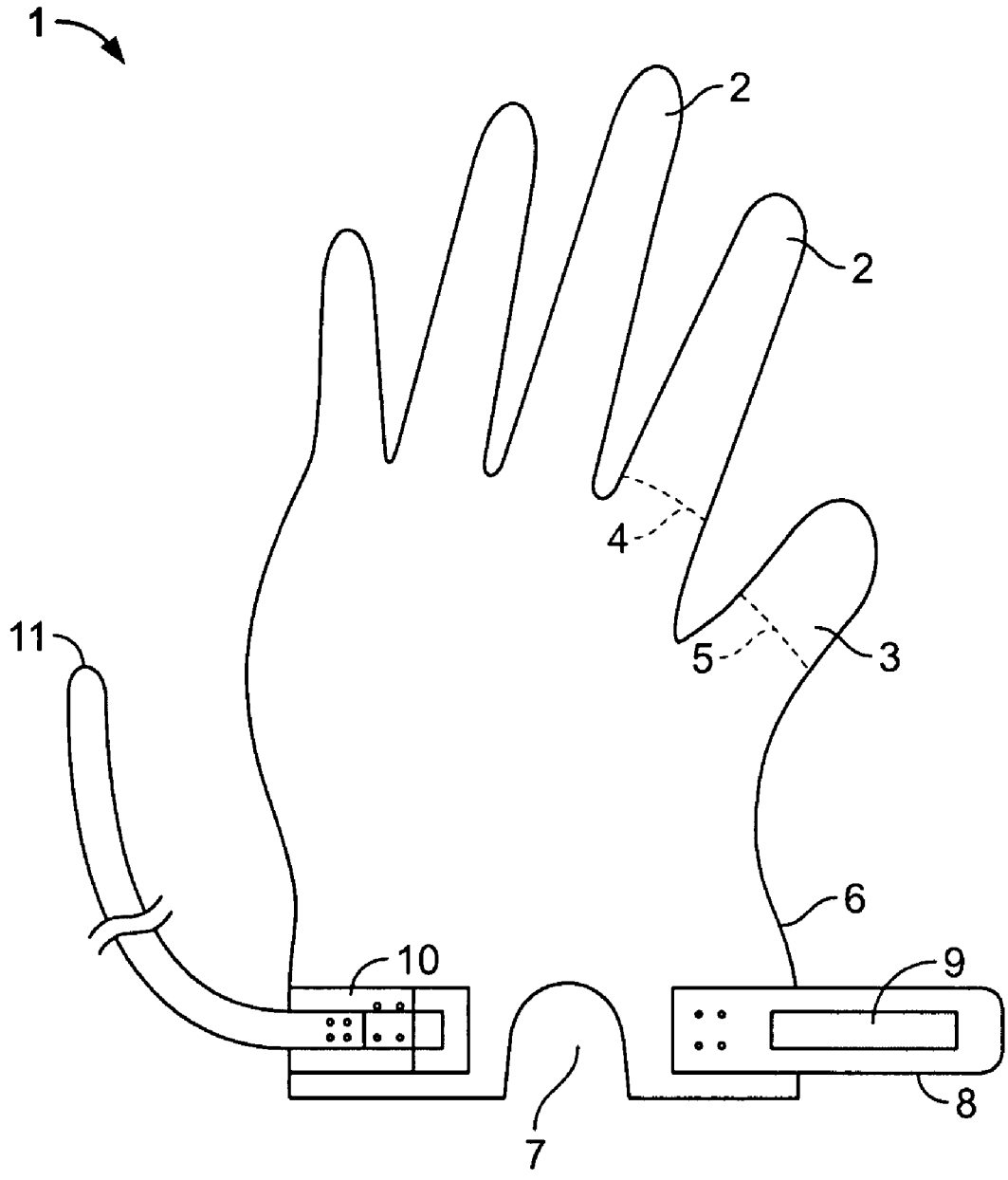
FIG. 1 is a plan view of the back of a glove according to this invention.
Figure 2:
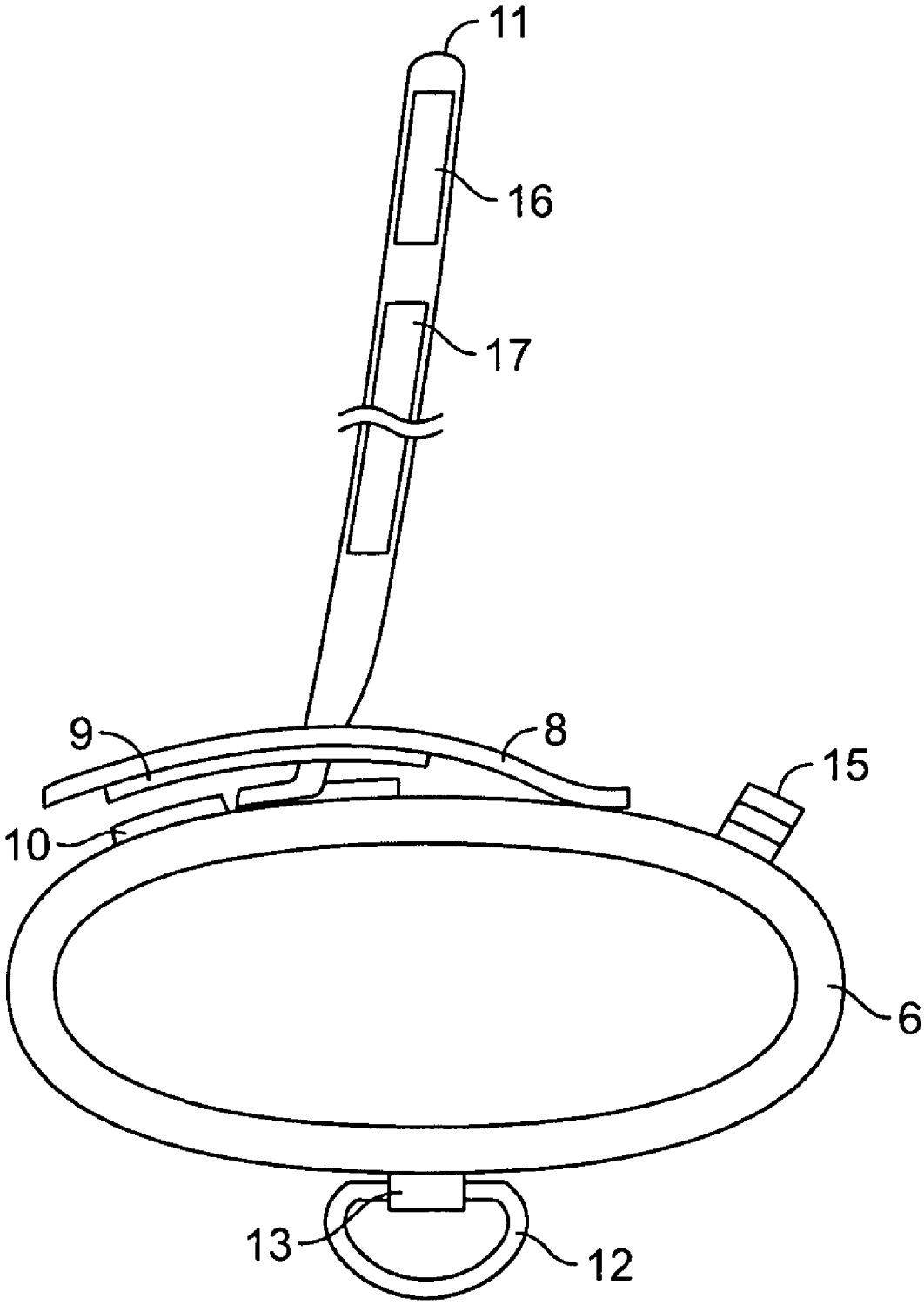
FIG. 2 is a cross sectional end view of a glove according to this invention taken through the wristband portion of the glove.
Figure 3:
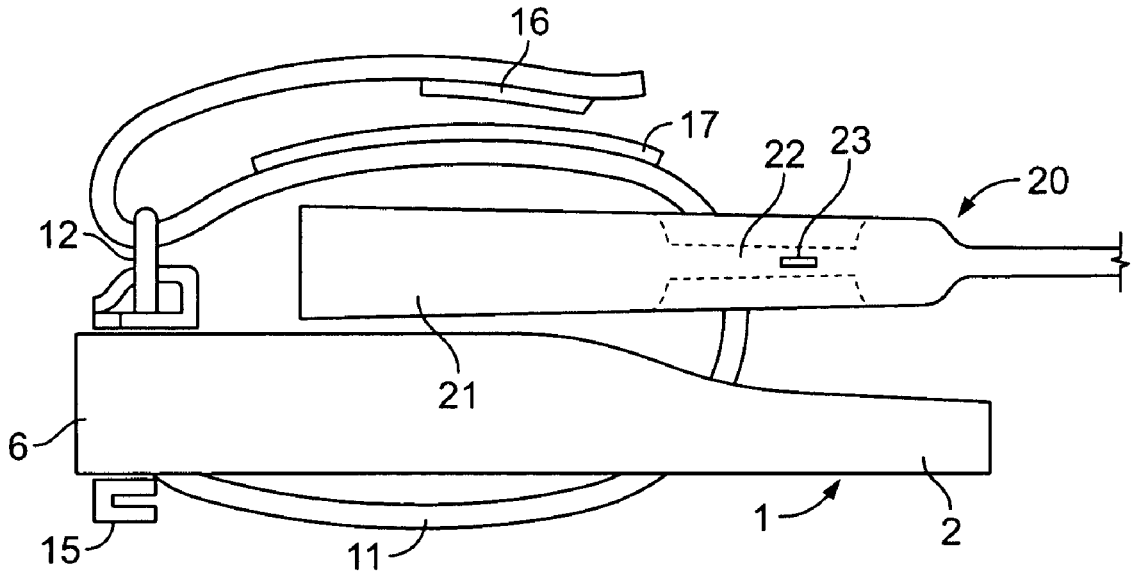
FIG. 3 is a cross sectional side view of a glove according to this invention taken through on the glove's fingers.

A preferred form of this invention is a firearm safety retaining glove. Construction of an embodiment of the glove is shown in FIGS. 1 to 3. Referring to FIG. 1, there is shown a top (or backside) view of a glove 1. The glove may include fingers 2 and thumb 3. Alternatively, portions of some or all of the fingers and thumb may be truncated to any desired extent, possibilities being shown for the index finger and thumb by dashed lines 4 and 5, respectively. Glove 1 may comprise leather or fabric, a fabric preferably being abrasion-resistant.

Glove 1 includes an adjustable wristband portion 6, conveniently with a cutout section 7 for tightening without bunching of glove material, although folding a glove material during tightening is a less preferred alternative. Wristband portion 6 includes tightening strap 8 and securing means for adjustably securing said strap. Any suitable securing means can be used, for example a buckle. My preferred closure is a hook-and-loop closure (or fastener) such as sold under and commonly known by the name Velcro®. One part 9 of the hook-and-loop system is included on the inside of tightening strap 8 and the other part 10 of the hook-and-loop system is attached to the outside of the back of wristband portion 6.

Secured to the back of glove 1 is safety retaining strap 11. My preferred construction is to attach retaining strap 11 in the trans-wrist direction as shown in FIG. 1 so that it can be wrapped around wristband portion 6 and secured to itself, as by a hook-and-loop releasable closure without any fold or bulge for storage, including when being worn by the user. Various arrangements will fulfill this criterion. One arrangement is to attach retaining strap 11 centrally to the wristband back. When wound in the direction away from tightening strap 8 during storage, tightening strap 8 will lie atop the first wind of strap 11, but the next wind of strap 11 will overlie strap 8. A storage loop 15 that is releasably engageable to itself and to retaining strap 11 (FIG. 2) can be included to secure strap 11 during storage. Loop 15 conveniently is a short fabric strap attached to wristband portion 6 at a convenient location on the top side or palm side of wristband portion 6 and provided with a hook-and-loop fastener. In this construction D-ring 12 (FIG. 2) is covered by strap 11 during storage.

Turning to FIG. 2, which shows wristband portion 6 in cross section from the wrist end of glove 1, there is shown D-ring 12. D-ring 12 is secured to the palm side of wristband portion 6, as by a fabric fold 13 sewn to wristband 6. D-ring 12 performs the function of providing a means to releasably and adjustably secure the free end of retaining strap 11 to the palm side of wristband portion 6. FIG. 2 shows retaining strap 11 unwound and ready for use. Tightening strap 8 is extended across the base of retaining strap 11 and releasably secured to wristband portion 6 by hook-and-loop closure 9, 10. Storage loop 15 for retaining strap 11 is not in use and is releasably secured to itself by its hook-and-loop closure. Strap 11 is provided with a hook-and-loop closure comprising first portion 16 proximate the free end of strap 11 and second portion 17 nearly adjacent to portion 16 toward the fixed end of strap 11. FIG. 3 shows glove 1 in cross section from the side, with safety retaining strap 11 in use to secure a firearm 20, which contains grip 21, trigger guard 22 and trigger 23. Strap 11 has been passed forward from the back side of wristband portion 6 (shown on the bottom of the figure), forwardly toward fingers 2, thence between two fingers 2 and through the rear of trigger guard 22, rearwardly along the palm side of glove 1 to D-ring 12. Strap 11 is passed through reversing D-ring 12, folded back on itself, pulled tightly toward fingers 2, and secured on itself by hook-and-loop closure 16, 17. As will be appreciated from FIG. 3, D-ring 12 and closure 16, 17 could be replaced by a strap-securing device attached to wristband portion 6, for example, a buckle.

During use the user grips the firearm handle 21 in the firing position, unwraps retaining strap 11 from its storage configuration, and, if not already done, tightens and secures strap 8. Then the user passes strap 11 between his or her fingers (including glove fingers 2 if present), and through the trigger guard of the firearm behind the trigger. Strap 11 is then fed through D-ring 12 on the palm side of the wristband, folded back on itself, tightened, and secured to itself by the hook-and-loop fastener 16, 17. The firearm is now secured. It is not, however, locked into the user's hand. Rather, it is locked to the user's wrist. It cannot be pulled away from the user, but the user can remove his hand from the gun to perform tasks and easily swing the gun, which has been prevented from falling away, into firing position.

Figure 4:
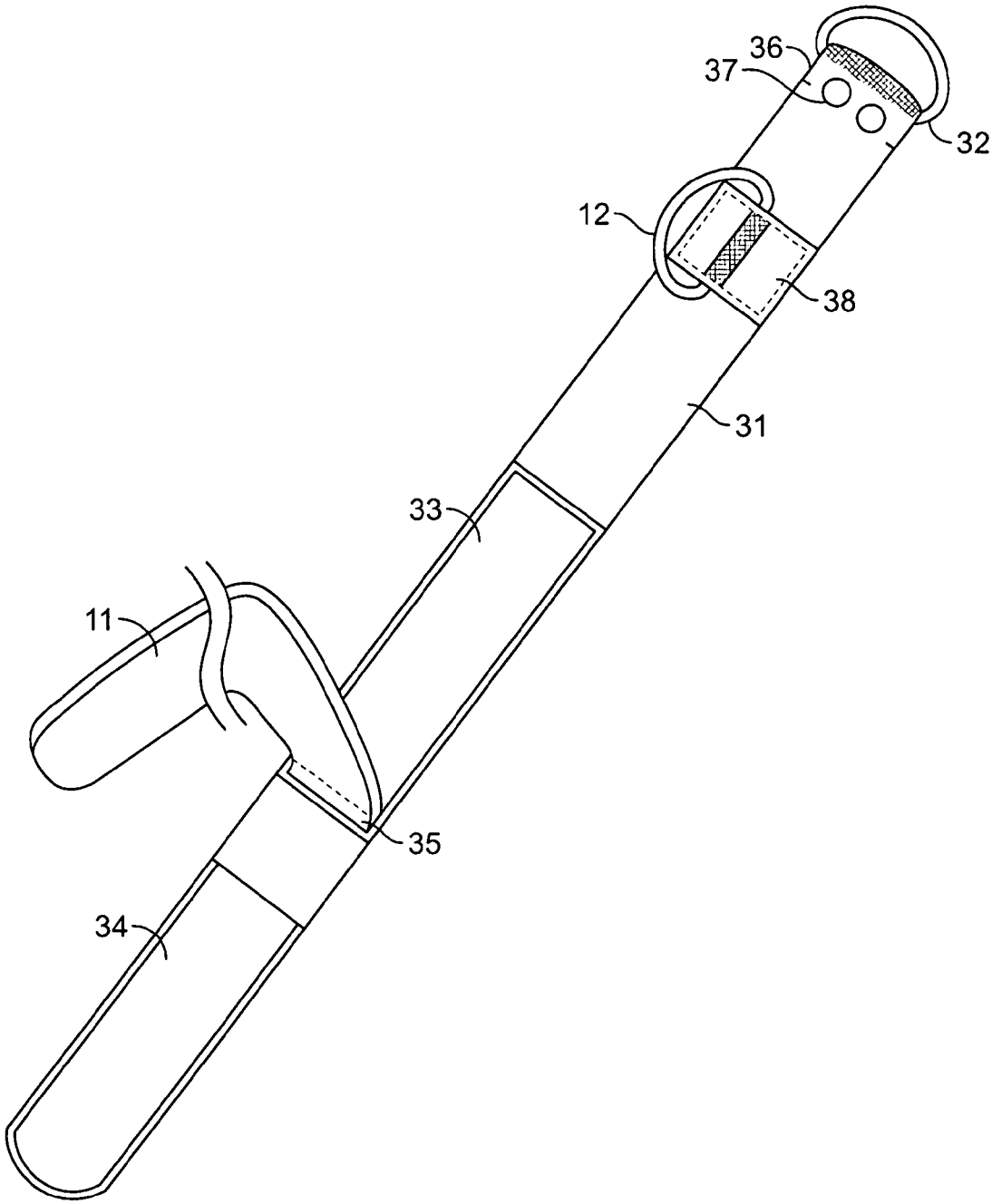
FIG. 4 is a perspective view of a wristband according to this invention.

FIG. 4 shows a wristband embodiment 31 of the invention. This embodiment can be sized to fit a user's wrist, similarly to the glove wristband portion 6 described above. It can also be sized to fit over the wristband portion of a conventional glove, for example, a glove suitable for hunting and shooting, if desired. Wristband 31 includes terminal D-ring 32 such that, for tightening, the opposite end of wristband 31, having encircled the user's wrist, can be passed through reversing D-ring 32, folded back on itself, tightened, and secured with a hook-and-loop fastener, one part 33 of which is attached onto the terminal portion of wristband 31 and the other part 34 of which is attached onto the adjoining portion of wristband 31. Wristband 31 includes a retaining strap 11 and D-ring 12 as described in connection with FIGS. 1 to 3. Retaining strap 11 functions during storage and use as described for glove 1. My preferred arrangement is one in which, when retaining strap 11 is deployed during use, tightened wristband 31 is closed over and covers the attachment 35 of retaining strap 12 to wristband 31. FIG. 4 shows alternative means for securing D-rings to a wristband 31 or 6. D-ring 32 is secured by a fabric fold 36 fixedly secured by rivets 37. D-ring 12 is secured by a sewn-on fabric patch 38. The construction utilizing a D-ring 32 could, as will be appreciated, be applied to wristband portion 6 of glove 1, such that tightening strap 8 could be passed through such a D-ring secured on the opposite side of wristband portion 6, folded back on itself and secured to itself by a hook-and-loop or other releasable closure. It will also be appreciated that for wristband 31, D-ring 32 could be replaced by a buckle, in which case hook-and-loop fastener 33,34 would not be utilized for securing wristband 31 to itself when tightened.

A specific implementation of glove 1 includes a three-quarter inch D-ring 12, either nickel plated steel or stainless steel, secured to wristband portion 6 by a fabric loop 13 sewn to wristband portion 6, optionally sewn as part of a terminal end seam of the wristband. Retaining strap 11 is a three-quarter inch fabric strap sewn to wristband portion 6 and provided at its free end with six inches of Velcro® hook material 16 and longer, up to twelve inches, of Velcro® loops material 17.

A specific implementation of wristband 31 includes a three-quarter inch wide leather strap 31 approximately twelve inches long, two three-quarter inch D-rings 12, 32 and a three-quarter inch wide fabric strap 11 approximately twelve inches long. Strap 11 is provided with a hook-and-loop closure as described, but it is also provided, on the opposite side near its attached end, with approximately three inches of loops material. Hook-and-loop portion 34 is approximately three inches of Velcro® hooks material, and portion 33 is approximately three inches of loops material, all edge sewn to wristband 31. For storage of wristband 31, the plain end, on the side opposite portion 34, is provided with approximately two inches of Velcro® hooks material, and the sewn end of strap 11, on the opposite side from closure 16, 17, is provided with approximately four inches of Velcro® loops material, the two forming a releasable closure for storage.

A number of embodiments of the invention have been described. Nevertheless, it will be understood that various modifications may be made without departing from the spirit and scope of the invention. Accordingly, other embodiments are within the scope of the following claims.

What is claimed is:

1. A firearm safety retaining glove comprising finger portions, a thumb portion, a palm side, a back side, and an adjustable wristband portion having a releasable closure, said adjustable wristband portion having an interior surface adjacent to a users wrist and an exterior surface opposite said interior surface a loop attached to said exterior surface of the palm side of the wristband portion attached to a central region of a back side of the wristband portion, a safety retaining strap having a free terminus, having a securing side and having a length sufficient for the strap to be passed through the finger portions, through a wearer's fingers, and through a firearm trigger guard to a palm side of the wristband, through the loop and folded back on itself, the safety retaining strap having hook-and-loop fastener system portions on its securing side proximate to and further distant from the free terminus, respectively, whereby the strap may be inserted through the loop, folded back on itself, tightened and releasably secured to itself adjacent the palm side of the glove.

2. The glove according to claim 1 wherein the releasable closure for the adjustable wristband portion is a hook-and-loop closure.

3. The glove according to claim 2 wherein the retaining strap is releasably securable to itself when wrapped around said wristband portion.

4. A firearm safety retaining wristband useable with a glove or alone comprising an adjustable wristband having a releasable closure, said adjustable wristband having an interior surface adjacent to a users wrist and an exterior surface opposite said interior surface attached to the adjustable wristband, a safety retaining strap and a first reversing loop through which the strap can be passed, the loop being attached to said exterior surface of the wristband, wherein, when the safety retaining strap is attached centrally on the back side of a user's wrist, the first reversing loop is located on the palm side of the user's wrist, the retaining strap including a free terminus, a securing side, and first hook-and-loop fastener system components, one of the first hook-and-loop fastener components being proximate said free terminus on said securing side and the other of the components being further distant from said free terminus on said securing side, wherein when the wristband is worn by a user with the retaining strap attached to the wristband on the back side of the user's wrist, the retaining strap can be passed forwardly through the user's fingers and a trigger guard of a firearm held by the user, then to and through the first reversing loop, folded back on itself and releasably secured to itself adjacent the user's palm.

5. The safety retaining wristband according to claim 4 wherein the wristband releasable closure comprises a second reversing loop secured to a first end of the wristband and a second hook-and-loop closure, wherein the wristband can be placed about a user's wrist, inserted through the second reversing loop, folded back on itself, and releasably secured to itself utilizing the second hook-and-loop closure.

6. The safety retaining wristband according to claim 4 wherein the retaining strap is releasably securable to itself when wrapped around said wristband.

* * * * *